United States Patent [19]

van Brück

[11] Patent Number: 4,677,559

[45] Date of Patent: Jun. 30, 1987

[54] CONTROL ARRANGEMENT FOR A COMBUSTION ENGINE

[75] Inventor: Heinrich E. van Brück, Eindhoven, Netherlands

[73] Assignee: U.S. Philips Corporation, New York, N.Y.

[21] Appl. No.: 692,090

[22] Filed: Jan. 17, 1985

[30] Foreign Application Priority Data

Jan. 30, 1984 [NL] Netherlands ..... 8400271

[51] Int. Cl.[4] ..... F02B 3/04; F02D 35/00

[52] U.S. Cl. ..... 364/431.05; 364/431.03; 123/489

[58] Field of Search ..... 364/431.04, 431.05, 364/431.11; 123/440, 489, 480

[56] References Cited

U.S. PATENT DOCUMENTS 4,345,561 8/1982 Kondo et al. ..... 364/431.04
4,348,729 9/1982 Sasayama et al. ..... 364/431.12
4,354,238 10/1982 Manaka et al. ..... 364/431.05

*Primary Examiner*—Parshotam S. Lall
*Attorney, Agent, or Firm*—Robert T. Mayer; Bernard Franzblau

[57] ABSTRACT

A known control arrangement for a combustion engine, adjusts the air:fuel ratio via a closed control loop using the oxygen content in the exhaust gases as a measurement parameter. However, this control arrangement only adjusts with accuracy to the stoichiometric value of the air:fuel ratio. A novel control arrangement is provided which adjusts and maintains an air:fuel ratio deviating from the said value. For this purpose, two sets of data are stored in a microprocessor system, one of which corresponds to an adjustment to the stoichiometric value and the other of which corresponds to the desired value. The control loop is closed periodically and adjustment to the first value takes place. The correction values found during the aforesaid adjustment are stored and are used again, as the case may be after adaptation, for the adjustment to the desired value.

3 Claims, 2 Drawing Figures

CONTROL ARRANGEMENT FOR A COMBUSTION ENGINE

Figure 1:
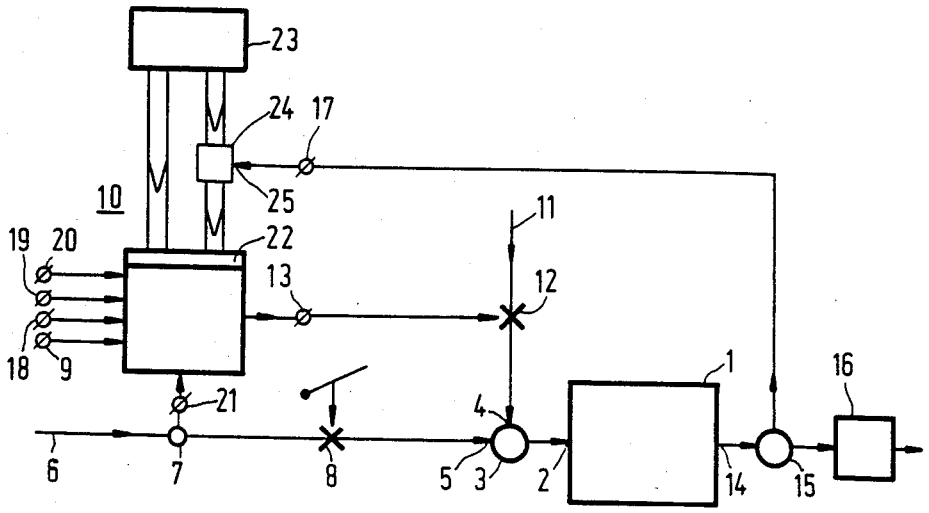

The invention relates to a control arrangement for a combustion engine comprising a plurality of sensors for measuring quantities which are characteristic of the combustion in the engine and a control unit which receives and processes the measurement signals from the sensors and which supplies output signals for control members. The control members control engine-operating parameters in order to obtain a desired combustion in the combustion engine and hence a desired operation thereof. A microprocessor system is included in the control unit and comprises memories for storing first values corresponding inter alia to the said measurement signals and to said output signals and to data in the form of tables and formulae coupling measurement and output signals and an oxygen sensor to be mounted in the exhaust system of the combustion engine. The oxygen sensor also supplies a measurement signal to the control unit. The latter signal is stored in the said memories together with first correction values derived from this measurement signal and used for varying output signals such that a given air:fuel ratio for a desired combustion remains adjusted by means of feedback in a closed control loop.

Such a control arrangement is known from U.S. Pat. No. 4,276,600. In the microprocessor system, data and stored (a ROM and a RAM) digital values of measurement signals together yield according to predetermined laws and calculation rules command signals by which, ultimately, control members for engine parameters can be controlled. The measurement signals are supplied by sensors for manifold pressure, air temperature, engine temperature, throttle position, oxygen content in the exhaust gases, crank-shaft position and engine speed. The command signals control, through energy amplifiers, the fuel pump and the fuel injection valves so that an air:fuel ratio equal to the stoichiometric value is obtained, wherein the regulation is made accurate by feedback of the actually measured oxygen content in the exhaust gases. The nature of this measurement results in a small inaccurate measurement signal variation being obtained in the range of the so-called rich mixture and the poor mixture, while a voltage jump that can be very readily detected is obtained when the stoichiometric value is exceeded. Therefore, it is not easy or simple to obtain a regulation deviating from this value with a sufficient accuracy and stability with the use of the same method of measuring, so that such regulation cannot be achieved by the measures of the known control arrangement.

An object of the invention is to provide a control arrangement by means of which air:fuel ratios can be adjusted and accurately maintained and whose values can differ from the stoichiometric value by a few tens of percents.

For this purpose, a control arrangement of the kind mentioned in the opening paragraph is characterized in that the control arrangement comprises a switching unit which supplies periodically during a first time period a first control signal and during a second time period a second control signal, in that the memories have stored therein, in addition to the first values for stoichiometric regulation of the air:fuel ratio, second values for obtaining an air:fuel ratio deviating from the stoichiometric value, in that the microprocessor system derives from the first correction values determined during the first time period according to a given algorithm, second correction values which form part of the said second values, and in that the control arrangement further comprises a change-over device which receives the first control signal from the switching unit and in response switches into use the memory with the first values in the microprocessor system so that the said closed control loop becomes active and receives the second control signal from the switching unit and hence switches into use the memory with the second values in the microprocessor system, the control loop then being open, i.e. without feedback.

It should be noted that a combustion engine can always be adjusted with one or more adjustment possibilities to a desired air:fuel ratio. In the design and in the factory the starting member is a standard engine which can be ideally adjusted. Various fixed adjustments and arithmetic relations between parameters are fixed mechanically or electronically so that in practice an individual engine can be adjusted to the optimum conditions mostly under given operating conditions using one or two adjustment quantities. By the use of a microprocessor system, in which many data and arithmetic operations are stored, a considerable improvement can be obtained. This is described extensively in U.S. Pat. No. 3,969,614.

The adjustment method just mentioned has major disadvantages. The variation of parameters is not taken into account because the control loop is open so that there is no feedback. A parameter once adjusted varies, for example, by contamination and wear of the mechanical part, by the fact that the measurement signals become less accurate, by variation in amplification factors or by drift phenomena. Due to the manufacturing tolerances, fixed adjustments of the individual engine can exhibit deviations with respect to the standard engine.

The control loop according to the invention has the advantage that the influence of the aforementioned phenomena is eliminated to a great extent by means of the feedback and that correction parameters are measured and calculated which can be used to provide an adjustment of the engine different from that with which parameters have been measured in the closed control loop. This other adjustment may lie in the rich mixture range because given catalysts in the exhaust system, which have to neutralize toxic substances, initiate together with fuel residues and additional air, favourable combustion processes. The other adjustment may also lie in the poor mixture range, which is of course much more economical and hence occurs most frequently. Especially if the fuel used is gas, the advantage of the invention becomes clearly manifest. An engine in which the fuel used is gas can be adjusted to the optimum so that the performances are high and the exhaust gases are comparatively clean. This adjustment lies in the lean mixture range, for example 20 to 30% of air excess, and the adjustment to this value should be accurate. However, variation phenomena, as a result of which the mixture becomes still leaner, may lead to failures in the combustion per cylinder, which results in the air pollution increasing again. The control arrangement according to the invention is sufficiently accurate to cause the influence of the said variation phenomena to be a minimum. Moreover, it has the advantage that the optimum combustion at the stoichiometric value of the air:fuel ratio is used as a reference quantity. The oxygen sensor senses this value, as a result of which is parameter not mentioned thus far, i.e. the variation in the composition of the fuel, is also eliminated.

In the article "Reines Abgas bei Otto-Motoren durch geschlossenen Regelkreis" by Zechnall and Baumann in the magazine "MTZ, Motor-Technische Zeitschrift", 34, Nr. 1, 1973, p. 7–11, various aspects already mentioned above are also disclosed and FIG. 1 clearly shows that clean exhaust gases are obtained with an adjustment in the poor range.

An advantage which may also be mentioned is that with this adjustment a catalyst may be dispensed with.

In given embodiments of the invention, the switching unit can comprise a pulse generator which supplies switching pulses for the change-over device having durations equal to the first and the second time periods and the switching unit comprises at least one input for supplying measurement signals from the said sensors to the pulse generator for influencing the said durations. For example, the engine speed measurement signal may be supplied to make the first time period equal to zero when the speed has the stalled value or when a high speed of 5000 or 6000 rev/min is reached. In the former case, the oxygen sensor is mostly inoperative and in the latter case the engine can start running differently, which is annoying for the driver. The crank-shaft position may also be supplied as an adjustment signal to give the first time period a value of 10 or 20 crank-shaft revolutions. The second time period may have, for example, a constant value of 20 or 30 seconds or may be determined inter alia by the operating conditions of the engine.

Attempts have already been made to obtain nevertheless a value deviating from unity by means of an oxygen sensor measuring at $\lambda=1$. It is suggested in DE-OS No. 3124676, corresponding to U.S. Pat. No. 4,442,817, first to measure at $\lambda=1$ and then to correct the control with the value obtained so that $\lambda=1$ is maintained. Subsequently, one of the command signals, for example for the fuel injection valves, is varied by an amount to obtain a value for $\lambda$ which deviates from unity. It is clear that a fairly arbitrary value for $\lambda$ is thus obtained, which is still dependent upon various parameters and upon deviations already mentioned in the preamble, such as drift or wear.

However, the invention provides a control arrangement which with the tables, formulae and further stored data for a standard engine essentially has a correct desired $\lambda$ value. Via the measurement at $\lambda=1$, small corrections are determined, are stored and, if necessary, are changed so that they can be used with the stored values for the desired $\lambda$ value, which otherwise might vary slightly without these corrections.

In U.S. Pat. No. 4,385,612 a control arrangement is suggested in which it is assumed that on an average a given $\lambda$ value can be obtained deviating from unity when a parameter in the regulation is periodically changed so that the arrangement is modulated between a maximum $\lambda$ value deviating from unity and $\lambda=1$. In this case, a measurement and indication can only be performed at $\lambda=1$. This is also a very inaccurate method which prevents the engine from running regularly especially as a $\lambda$ value on an average would have to be obtained that is equal to the values that can be adjusted with the control arrangement according to the invention.

Figure 2:
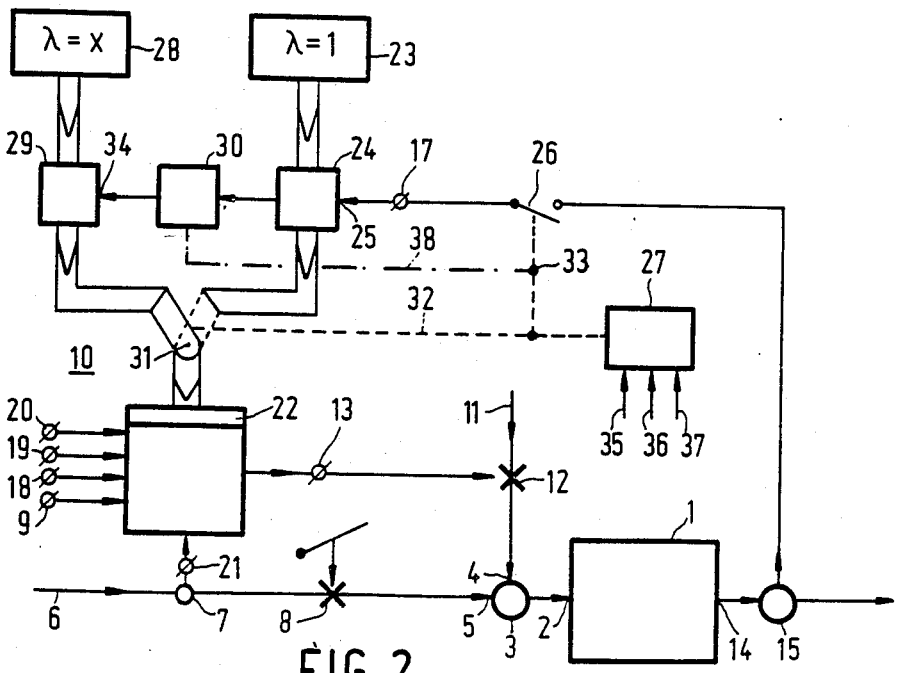

The invention will be described more fully with reference to the drawing. In the drawing:

FIG. 1 shows a block circuit diagram of a known control arrangement for a combustion engine; and FIG. 2 shows a block circuit diagram of a control arrangement according to the invention for a combustion engine.

In FIG. 1, a combustible engine 1 is provided with an inlet 2 for supplying thereto a combustion mixture which is obtained by supplying in a mixing space 3 fuel at an inlet 4 and oxygen at an inlet 5. The oxygen will mostly be included in the ambient air, which is sucked in at an inlet 6 and is measured directly with a sensor 7 as mass flow. The air supply can also be calculated using quantities representing throttle position, manifold pressure, engine speed, air velocity and air temperature. The supply can be controlled by means of a throttle 8, whose position is supplied as a measurement signal to an input 9 of a control unit 10. The fuel is supplied from a supply vessel (not shown) at a connection 11 and is then passed to the inlet 4 via control members represented by the sumbol 12. It should be noted that the mixing space 3 may also be any cylinder of the engine 1, the inlet 5 being the inlet valve and the inlet 4 being an injection valve, while the control members 12 may include the electromagnetic actuation of each injection valve per cylinder, each actuated by an output signal at the output 13 of the control unit 10, as well as the fuel pump which also receives an output signal at the output 13. The engine 1 is further provided with an exhaust 14 for the combustion gases which pass an oxygen sensor 15 and, as the case may be, a catalyst system 16. The oxygen measurement signal is supplied to an input 17 of the control unit 10. Further inputs 18, 19 and 20 are indicated for measurement signals from sensors which measure, for example, the crank-shaft position, the engine speed, the manifold pressure, the air temperature and the engine temperature. The air mass flow meter 7 is connected to an input 21. The control unit 10 comprises a microprocessor system 22, 23, 24 having memories 25 in which the data are stored which are associated with an optimum adjustment of a standard engine, the various signals at the inputs 9, 18, 19, 20 and 21 being the parameters. One example of a microprocessor system suitable for use in this engine control arrangement is the Philips PCB 83C552. At the output 13, which is shown as a single output, but which may comprise several outputs, also with different kinds of output signals for different types of control members, there are then supplied control signals which ultimately determine the combustion process in the engine. Thus far, the control loop is still open because there is no feedback. When the combustion process is controlled, for example, by measuring the oxygen content in the exhaust gases by means of the sensor 15, a closed control loop can be realized. The control unit 10 for this purpose comprises a correction circuit 24 represented as a block, an input 25 of which is connected to the input 17 for the oxygen measurement signal. The correction circuit 24 comprises a comparison circuit which compares the oxygen measurement signal with stored reference quantities from the memories 23 and produces correction values in the case of inequality, as a result of which given control parameters are processed in the part 22 so that corrected output signals are formed at the output 13. The combustion will now vary again with these signals, as is desired. As stated, the character of the oxygen measurement by the sensor 15, which may be a zirconium dioxide sensor, means that only the steep edge in the measurement voltage can be determined accurately, which consequently corresponds to an air:fuel ratio equal to the stoichiometric value. This combustion state is also expressed in the air excess number or air number lambda: the ratio of the quantity of air actually supplied to the quantity of air theoretically required for complete combustion. The regulation of FIG. 1 is therefore with lambda = 1.

In FIG. 2, the parts also present in FIG. 1 are provided with the same reference symbols. The catalyst 16 is omitted because with a lean mixture the exhaust gases can be sufficiently clean. The lead from the sensor 15 to the input 17 includes a switch 26 which is actuated by a switching unit 27 which periodically closes the switch. The storage capacity of the microprocessor system 22, 23, 24 is extended with the units 28, 29 and 30. In the memories 28 are stored the values and data which produce in conjunction with the measurement signals at the inputs 9, 18, 19, 20, 21 output signals at the output 13, as a result of which the combustion in the engine 1 is effected so that in the exhaust gases lambda has the desired value x, which deviates from one and is consequently preferably larger than one, for example 1.25. A change-over device 31 is then in the position shown. This device receives via the symbolic dotted line 32 control signals from the switching unit 27, as does the switch 26 via the dotted line 33. In the other position of the change-over device 31 and with closed switch 26, the control arrangement of FIG. 1 is obtained. However, the correction values produced in the correction circuit 24 are also passed on to an adaptation unit 30 which supplies the adapted values to the input 34 of the correction circuit 29. In this circuit the corresponding reference quantities stored in the memories 28 are corrected so that a variation of lambda from the value x is also corrected. The correction values determined for $\lambda = 1$ can now be used for correcting given stored data for $\lambda = x$, and if necessary adapted to the difference in the stored data for lambda is x and for lambda is one.

The switching unit 27 may be provided with inputs 35, 36 and 37 to supply signals which depend upon operating conditions, such as engine speed, crank-shaft position, acceleration of the vehicle whose engine is the driving energy source, the position of the gear lever, etc. Thus, it may be achieved that the periodic change-over is interrupted and lambda is one or lambda is x is maintained for a longer time, or that the time periods in which change-over normally takes place are varied in order that, should the engine run irregularly, these irregularities are reduced to a minimum. In FIG. 2, a dot-and-dash line 38, which extends from the line 33 to the unit 30, indicates that it is also possible that a gate circuit in the unit 30 receives a control signal from the switching unit 27 in order that the correction values obtained in the first time period are passed on to the unit 29 after adaptation. The switch 26 may then be omitted.

What is claimed is:

1. A control arrangement for a combustion engine comprising, a plurality of sensors for measuring quantities which are characteristic of the combustion in the engine, a control unit which receives and processes the measurement signals from the sensors and which supplies output signals for control members, which control members control engine-operating parameters in order to obtain a desired combustion in the combustion engine and hence a desired operation thereof, a microprocessor system included in the control unit and including memories for storing first values corresponding inter alia to the said measurement signals and to said output signals and to data in the form of tables and formulae, an oxygen sensor to be mounted in the exhaust system of the combustion engine to supply an oxygen measurement signal to the control unit, said oxygen signal being stored in the memories together with first correction values derived from the oxygen measurement signal and used for varying output signals such that a given air:fuel ratio for a desired combustion remains adjusted by feedback in a closed control loop, a switching unit which periodically supplies a first control signal during a first time period and a second control signal during a second time period, wherein the memories have stored therein, in addition to the first values for stoichiometric regulation of the air:fuel ratio, second values representative of an air/fuel ratio that deviates from the stoichiometric value, wherein the microprocessor system derives second correction values from the first correction values determined during the first time period according to a given algorithm such that the second correction values form a part of said second values, and a change-over device which receives the first control signal from the switching unit and in response switches into operation the memory with the first values so that the closed control loop is operative, and which receives the second control signal from the switching unit and in response switches into operation the memory with the second values whereby the control loop is then open.

2. A control arrangement as claimed in claim 1, wherein the switching unit comprises a pulse generator which supplies to the change-over device switching pulses having durations equal to the first and second time periods.

3. A control arrangement as claimed in claim 2, wherein the switching unit has at least one input for supplying measurement signals from the said sensors to the pulse generator for influencing the said time periods.

* * * * *